US008939192B2

(12) United States Patent
Solesbee et al.

(10) Patent No.: US 8,939,192 B2
(45) Date of Patent: Jan. 27, 2015

(54) TWO CAVITY MOLDS AND METHODS OF MANUFACTURING A GOLF CLUB HEAD

(71) Applicant: Karsten Manufacturing Corporation, Phoenix, AZ (US)

(72) Inventors: Rick Solesbee, Phoenix, AZ (US); Rick MacMillan, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/022,649

(22) Filed: Sep. 10, 2013

(65) Prior Publication Data

US 2014/0251567 A1 Sep. 11, 2014

Related U.S. Application Data

(60) Provisional application No. 61/773,131, filed on Mar. 5, 2013.

(51) Int. Cl.

| | |
|---|---|
| ***B22D 29/02*** | (2006.01) |
| ***B22D 33/04*** | (2006.01) |
| ***A63B 53/04*** | (2006.01) |
| ***B22D 25/02*** | (2006.01) |
| ***B22C 7/02*** | (2006.01) |

(52) U.S. Cl.

CPC ..... *A63B 53/04* (2013.01); *B22D 25/02* (2013.01); *B22C 7/02* (2013.01)

USPC ..... 164/47; 164/69.1; 164/137

(58) Field of Classification Search

CPC ..... B22D 25/00; B22D 25/02; B22C 9/22

USPC ..... 164/47, 69.1, 137, 131

See application file for complete search history.

(56) References Cited

U.S. PATENT DOCUMENTS

| | | | |
|---|---|---|---|
| 5,350,002 | A | 9/1994 | Orton |
| 5,547,630 | A | 8/1996 | Schmidt |
| 6,299,816 | B1 | 10/2001 | Takemoto et al. |
| 6,406,654 | B1 | 6/2002 | Perez et al. |
| 6,739,376 | B1 | 5/2004 | Cheng et al. |
| 6,830,093 | B2 | 12/2004 | Bramley |
| 6,971,436 | B2 | 12/2005 | Huang |
| 7,152,656 | B2 | 12/2006 | Huang et al. |
| 7,360,578 | B2 | 4/2008 | Tseng |
| 2005/0034834 | A1 | 2/2005 | Huang |
| 2005/0039877 | A1 | 2/2005 | Bramley |
| 2005/0224207 | A1 | 10/2005 | Huang |

*Primary Examiner* — Kevin P Kerns
*Assistant Examiner* — Steven Ha

(57) ABSTRACT

A method of manufacturing a golf club head can include: creating a mold of the golf club head; forming two or more portions of a model of the golf club head using the mold, each of the two or more portions of the model include a part of a body of the golf club head and at least one first alignment mechanism; assembling the model of the golf club head using the at least one first alignment mechanism of each of the two or more portions of the model to align the two or more portions of the model, the model comprises the body of the golf club head and a joined alignment mechanism, the joint alignment mechanism comprises the at least one first alignment mechanism of each of the two or more portions of the model; using the model of the golf club head to create a cast for the golf club head; removing the model of the golf club head from the cast; and using the cast of the golf club head to create the golf club head with the joined alignment mechanism; and removing the joined alignment mechanism from the golf club head. Other embodiments are disclosed.

15 Claims, 8 Drawing Sheets

Fig. 3
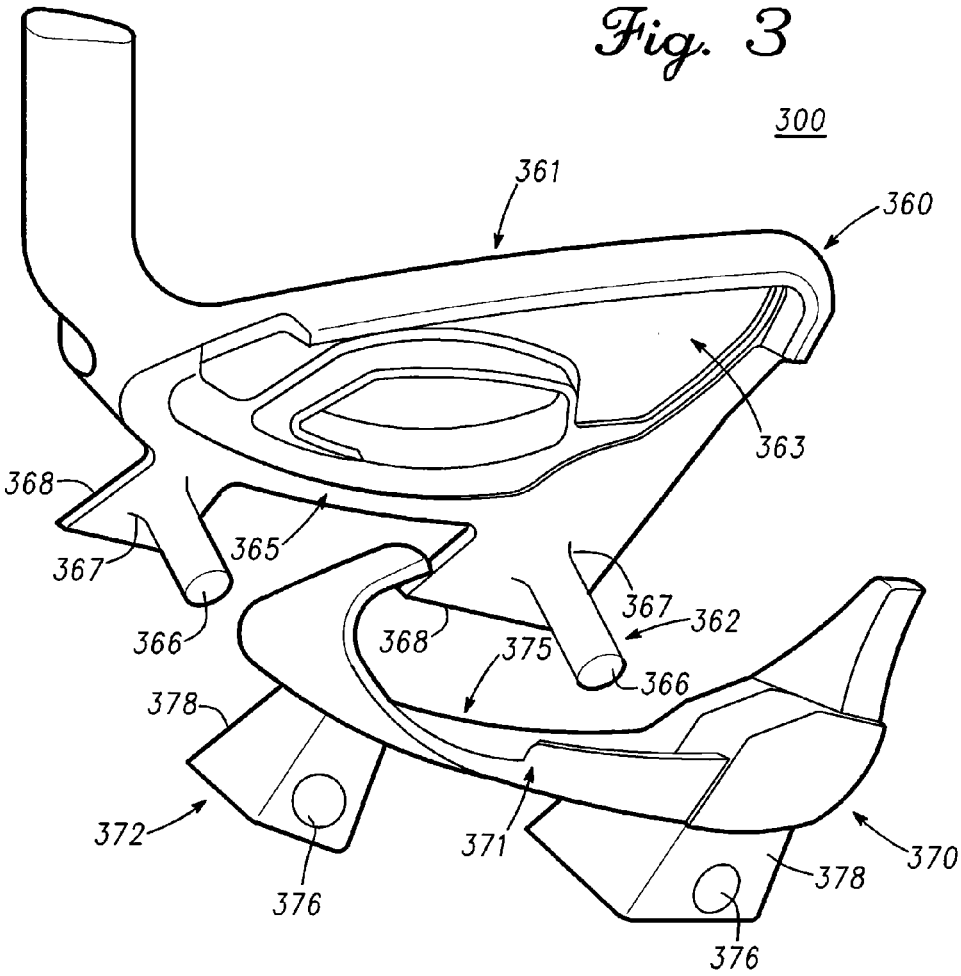
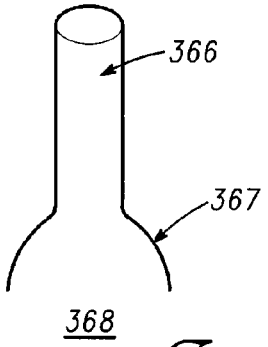
Fig. 4
Fig. 5
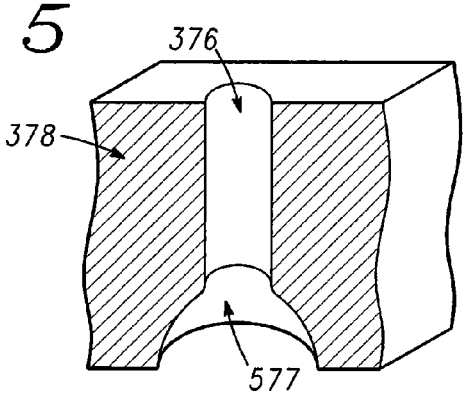

TWO CAVITY MOLDS AND METHODS OF MANUFACTURING A GOLF CLUB HEAD

CROSS-REFERENCE TO RELATED APPLICATIONS

This application claims the benefit of U.S. Provisional Application No. 61/773,131, filed Mar. 5, 2013. U.S. Provisional Application No. 61/773,131 is incorporated herein by reference.

TECHNICAL FIELD

This disclosure relates generally to method of manufacturing, and relates more particularly to methods of manufacturing golf club heads and wax models used in manufacturing processes.

BACKGROUND

Traditionally, manufacturers produce some types of golf clubs (e.g., iron golf clubs or hybrid golf clubs) using a lost wax casting process. Conventional lost wax processes include creating a wax model from multiple pieces that are assembled and disassembled every time a new wax model is created using a mold.

Over time, the pieces of the model in the traditional method have a tendency to deform or become damaged. Once a piece becomes damaged or deformed, it can no longer be used because its imperfections will transfer to the wax models new pieces must be made. The constant assembly and disassembly of the pieces along with the regular replacement of damaged and/or deformed pieces increases the cost, time, and complexity needed to create objects such as golf clubs.

Accordingly, a need or potential for benefit exists for a method or system that allows creation of objects such as golf clubs without the problems of the traditional lost wax casting process.

BRIEF DESCRIPTION OF THE DRAWINGS

To facilitate further description of the embodiments, the following drawings are provided in which:

FIG. 3 illustrates an example of first model portion and a second model portion of a model, according to the first embodiment;

FIG. 4 illustrates an example of the projection of the first model portion of FIG. 3, according to the first embodiment;

FIG. 5 illustrates an example of the aperture of the second model portion of FIG. 3, according to the first embodiment;

Figure 1:
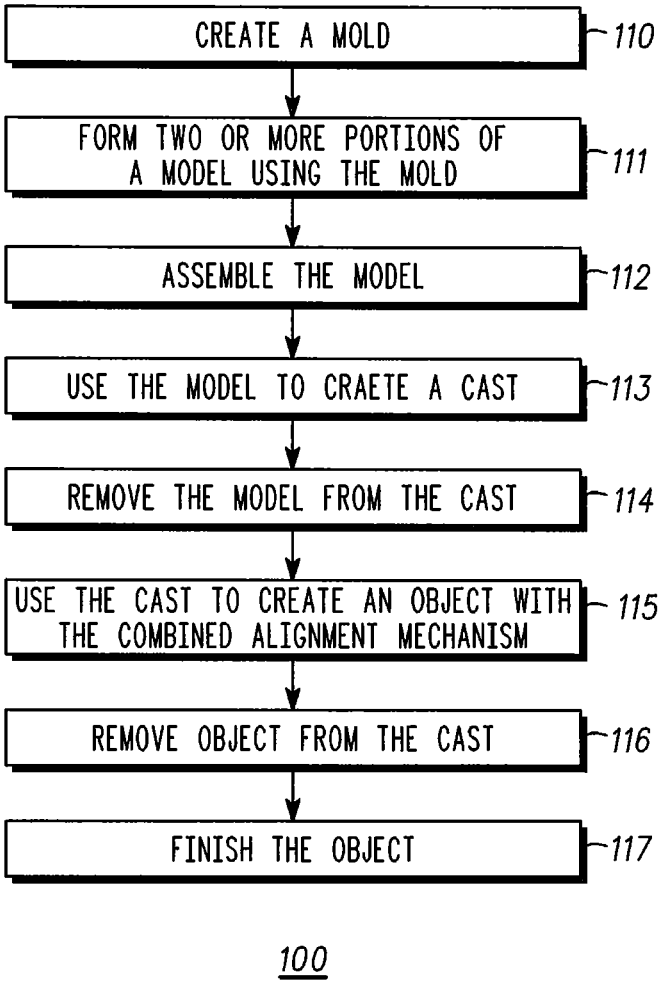
FIG. 1 illustrates a flow chart for an embodiment of a method of manufacturing an item or object.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise. Two or more electrical elements may be electrically coupled but not be mechanically or otherwise coupled; two or more mechanical elements may be mechanically coupled, but not be electrically or otherwise coupled; two or more electrical elements may be mechanically coupled, but not be electrically or otherwise coupled. Coupling may be for any length of time, e.g., permanent or semi-permanent or only for an instant.

"Mechanical coupling" and the like should be broadly understood and include mechanical coupling of all types. The absence of the word "removably," "removable," and the like near the word "coupled," and the like does not mean that the coupling, etc. in question is or is not removable.

DESCRIPTION

Some embodiments disclose a method of manufacturing a golf club head. The method can include: creating a mold of the golf club head; forming two or more portions of a model of the golf club head using the mold, each of the two or more portions of the model include a part of a body of the golf club head and at least one first alignment mechanism; assembling the model of the golf club head using the at least one first alignment mechanism of each of the two or more portions of the model to align together the two or more portions of the model, the model comprises the body of the golf club head and a joined alignment mechanism, the joint alignment mechanism comprises the at least one first alignment mechanism of each of the two or more portions of the model; using the model of the golf club head to create a cast for the golf club head; removing the model of the golf club head from the cast; and using the cast of the golf club head to create the golf club head with the joined alignment mechanism; and removing the joined alignment mechanism from the golf club head.

Various embodiments disclose a method of building an object. The method can include: providing a mold of the object; making two or more portions of a model of the object using the mold, each of the two or more portions of the model include a part of the object and at least one first alignment mechanism; making the model of the object using the at least one first alignment mechanism of the two or more portions of the model to align the two or more portions of the model, the model comprises a body of the object and a joined alignment mechanism; making a cast for the object using the model; removing the model of the object from the cast; making the object using the cast of the object such that metal is injected into the cast at least partially through the joined alignment mechanism; and removing the joined alignment mechanism after making the object. The joined alignment mechanism comprises the at least one first alignment mechanism of the two or more portions of the model after the two or more portions have been aligned together.

Further embodiments disclose a wax model configured to be used in casting a golf club head. The wax model can include: a first portion of the wax model, the first portion can have: a model of a first part of a body of the golf club head; a first common contact portion; and a first alignment mechanism; and a second portion of the wax model, the second portion of the wax model configured to couple to the first portion of the wax model, the second portion can have a model of a second part of the body of the golf club head; a second common contact portion configured to be adjacent to the first common contact portion when the second portion of the wax model is coupled to the first portion of the wax model; and a second alignment mechanism configured to couple to the first alignment mechanism such that the first portion of the wax model and the second portion of the wax model are aligned when the second portion of the wax model is coupled to the first portion of the wax model.

Turning to the drawings, FIG. 1 illustrates a flow chart for an embodiment of a method 100 of manufacturing an item or object (e.g., a golf club head). The method 100 can also be considered a method of manufacturing the item or object using a casting process. The method 100 is merely exemplary and is not limited to the embodiments presented herein. The method 100 can be employed in many different embodiments or examples not specifically depicted or described herein. In some embodiments, the activities, the procedures, and/or the processes of the method 100 can be performed in the order presented. In other embodiments, the activities, the procedures, and/or the processes of the method 100 can be performed in any other suitable order. In still other embodiments, one or more of the activities, the procedures, and/or the processes in the method 100 can be combined or skipped.

Not to be taken in a limiting sense, a simple example of the method of manufacturing (e.g., casting) can involve manufacturing (e.g., casting) a golf club head. First, a negative mold of the golf club head is injected with wax to create a wax model of the golf club head. The wax model is then used to create a cast for the golf club head. After the cast is created, the wax is melted out of the cast and replaced with molten liquid metal to create the golf club head.

In this simple example, the wax model can include at least a first two-sided mold cavity and a second two-sided mold cavity. Each of the cavities can include an alignment mechanism and a common contact surface integrated into the mold cavities. The mold cavities are configured to provide a completed wax model of the golf club head. Both mold cavities are designed such that there is an "unobstructed removal axis" for each of the mold cavities to be removed from the cast. The alignment mechanism facilitates fusing the two common contact surfaces to create a complete wax model of the golf club head. In various embodiments, this method is an improvement to the lost wax casting method of casting a metal item or object.

The golf club head can be an iron-type golf club head, such as a 1-iron, a 2-iron, a 3-iron, a 4-iron, a 5-iron, a 6-iron, a 7-iron, an 8-iron, a 9-iron, a sand wedge, a lob wedge, a pitching wedge, an n-degree wedge (e.g., 44 degrees (°), 48°, 52°, 56°, 60°, etc.), etc. In a different embodiment, the golf club head can also be a wood-type golf club, a hybrid-type golf club, or a putter-type golf club.

In some examples, the golf club head can be manufactured from a steel material, aluminum material, another metal, or one or more other materials by a casting process, a forging process, a combination thereof, or one or more other suitable manufacturing processes. In some examples, the method described herein is only one part of the manufacturing process for the golf club head. In many examples, the golf club head can be formed as a unitary body. In other examples, the golf club head can be made of multiple pieces (e.g., a separate face plate and/or separate inserts to form the grooves), and one or more of the pieces of the golf club head can be manufactured using method 100.

Referring to FIG. 1, method 100 includes an activity 110 of creating a mold of an item. In some examples, activity 110 can include creating a mold of a golf club head. In the rest of the description of method 100, a golf club head is used as an example of an item or an object that can be manufactured using method 100. In other examples, other items or objects can be created using method 100.

Figure 2:
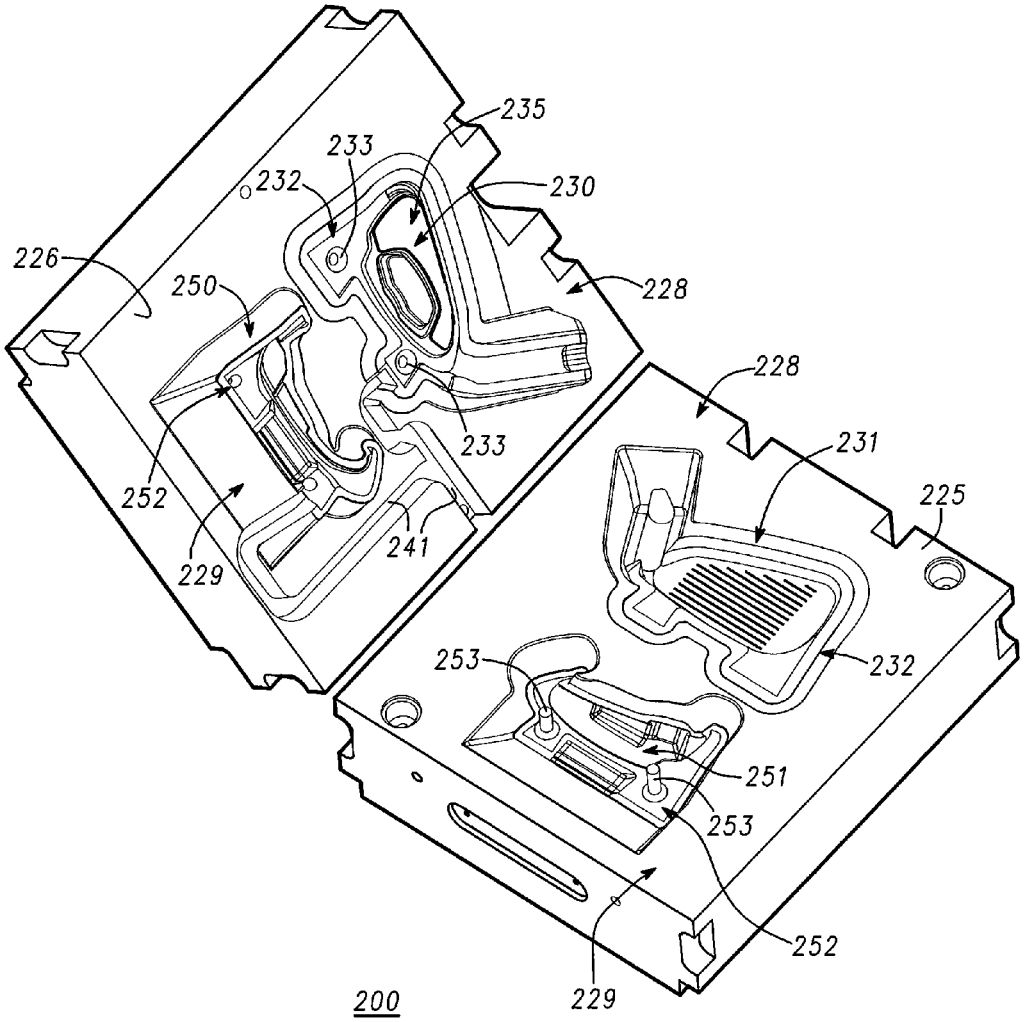
FIG. 2 illustrates an example of a mold for a golf club head, according to a first embodiment.

In some embodiments, creating the mold can first involve designing or modeling the two or more mold cavities or portions. Designing the mold cavities or portions involves identifying one or more separation planes on which the object that is being molded can be split. Designing the mold cavity with one or more separation planes allows creation of mold cavities that have an "unobstructed removal axis" for facilitating removal from the cast. FIG. 2 illustrates an example of a mold 200 for a golf club head, according to an embodiment. In the example shown in FIG. 2, the separation planes create the common contact surface of model that can later be used to assemble a complete wax model of the golf club head. In many examples, a prototype of the object can be used to identify one or more separation planes and divide the object into two or more pieces (either physically or virtually) using a computer program such as a CAD (computer-aided design) program.

After dividing the shape of the golf club head or other object into two or more pieces, activity 110 involves creating a negative image mold of each of the two or more portions of the wax model of the golf club head. In various embodiments, a computer program such as a CAD program can be used to create the negative image.

Subsequently, activity 110 can involve producing or creating the mold. In some examples, the mold can be machined into a material, created using an epoxy method, crated using an electrical discharge machine, created using a directed laser sinter, or built using a negative mold around a prototype of the object. In some examples, the mold can be made from aluminum, steel (ferrous or non-ferrous steel), epoxy, or any other suitable material.

In the example of FIG. 2, mold 200 of the golf club head has been divided into two mold portions: a first mold portion 228 for the strike face and a second mold portion 229 for the sole/toe/heel portions. First mold portion 228 is in the upper mold cavity of mold 200, and second mold portion 229 is the lower mold cavity of mold 200.

First mold portion 228 can include strike face mold 231, the reverse side mold 235 of the strike face (i.e., the back cavity with a weight portion), a common contact surface 230, and an alignment mechanism 232.

Second mold portion 229 can include sole/toe/heel mold 250 (i.e., the mold of the sole portion and most portions of the toe and heel of the golf club head), a common contact surface 251, and an alignment mechanism 252.

Mold 200 includes a first side 225 and a second side 226 that can be pressed, folded, or otherwise coupled together when creating the model of the golf club head. In one example, first side 225 can include the strike face mold 231 and common contact surface 251 and portions of alignment mechanisms 232 and 252. Second side 226 can include common contact surfaces 230, reverse side mold 235, and portions of alignment mechanisms 232 and 252. In other examples, different portions can be included on each side of mold 200. In various embodiments, second side 226 can include pathways 241 for the wax to be injected into mold 200. In other examples, first side 225 can include at least part of pathways 241.

In some examples, alignment mechanism 232 can include one or more cylindrical indentions 233. Cylindrical indentions 233 produce the wax protrusions 366 on first part of the wax model 300 (FIG. 3). Alignment mechanism 252 can include one or more pins or protrusions 253. Pins or protrusions 253 in second mold portion 229 leave two holes in the resulting wax model. The holes will receive the protrusions from the face portion, aligning common contact surfaces 230 and 251. Protrusions 253 produce holes 376 in the second part of wax model 300 (FIG. 3). Indentions 233 and protrusions 253 are designed to be complementary of each other. The wax protrusions and holes ensure that common contact surfaces 230 and 251 are properly aligned.

In many examples, the alignment mechanism of each of the two or more portions is located adjacent to a thickest portion of the golf club head. Placing the alignment mechanism adjacent to the thickest portions of the golf club head provide benefits when casting the golf club head as described below in relation to activity 113 of FIG. 1. In some examples, alignment mechanisms 232 and 252 can be part of a wax model of the sprue for the golf club head.

This molding process also provides an easy solution for adding indicia to the wax model. For example, a sole number indicating which golf club is being made can be added to second mold portion 229 to mark the wax model, or a logo or word can be inserted into first mold portion 228. The additions can be magnetized or just placed in the mold prior to closing. Then when the wax is injected, the shape of the addition will be integrated into the wax model.

For comparison, the traditional "single cavity" mold uses a single cavity mold and various inserts. The various inserts would be added to (e.g., place inside) the single cavity to create the detail on the golf club. That is, in the traditional method, the wax model is removed from the single cavity mold in one complete piece. In order to remove the one-piece wax model without damage, there must be no obstructions in the mold. Therefore, to create all of the details, recesses, grooves, or indicia of the golf club, a collection of various inserts would be pieced together like a puzzle in the beginning of the process. After the wax hardens in the single cavity mold, the inserts must then be carefully removed to clear a removal path for the wax model. No damage can be done to the wax model during the removal process or the wax model will have to be discarded.

Over time, as the inserts in the traditional method are added and removed from the single cavity mold over and over again, they have a tendency to deform and/or become damaged. Once an insert becomes damaged or deformed, it can no longer be used because the imperfection will transfer to the wax model. When the inserts can no longer be used, new inserts must be made. This regular replacement of the inserts increases the cost, the time, and the complexity of the manufacturing process.

Furthermore, the inserts of the traditional method may leave seams in the wax model. The seams are created by the contact seams of the inserts with each other, and the seams get larger and/or deeper over time as the inserts wear out. Therefore, it is necessary to constantly monitor the quality of the wax models and the inserts when using the traditional process.

The mold method described herein avoids these problems. The mold described herein does not use inserts that have to be repeatedly coupled to and removed from the mold cavity. Accordingly, the systems and the methods described herein make the manufacturing process faster and less laborious for the individual creating the models. The mold, as described herein, is also more resilient and less likely to be damaged because it does not require as much handling when creating the wax models. The mold, as described herein, is much less likely to acquire imperfections or damage when compared to prior art inserts. The mold, as described herein, also avoids the issue of having to replace inserts, making it cheaper and decreasing the time and hassle of the manufacturing process.

Moreover, the mold, described herein, does not require use of the burdensome inserts because the details of the golf club are milled or otherwise embedded into the mold. The mold described herein allows the manufacturer to add all the golf club head detail to the wax model without creating obstructions that interfere with the removal process. The portions of the wax model are optimized by identifying a precise "separation plane" through which the golf club head that is being modeled can be split. In the example of FIGS. 2-11, the separation plane creates the common contact surface of the two-wax model portions as discussed above.

The separation plane is a plane that cuts the golf club head into two or more pieces such that the pieces can be removed from the mold along an unobstructed removal axis. In some embodiments, the golf club head may require more than one separation plane (e.g., more than two portions to the wax model) to achieve the unobstructed removal axis. When the separate portions of the golf club head are selected such that each portion has an unobstructed removal axis, the respective portions can be removed from the multi-portion mold without being damaged, and without the use of inserts, like the traditional method.

Furthermore, the mold described herein leaves fewer seams in the wax model, it is a faster process, the mold does not acquire imperfections like the inserts of the traditional method, and there is no need to replace inserts when using the method 100. Despite all of the advantages gained by the mold described herein, nearly nothing is lost in the ability to create detail in the golf club head or other objects.

Referring back to FIG. 1, the method 100 in FIG. 1 continues with an activity 111 of forming two or more portions of a model using the mold. In various examples, activity 111 can include inserting wax into the mold. For example, wax can be inserted into mold 200 (FIG. 2) using pathways 241 (FIG. 2) after the mold is closed. After allowing the wax to cool and harden, the two or more portions of the wax model can be removed from the mold. The two or more portions of the wax model are configured such that an unobstructed removal axis exists for each of the two or more portions of the wax model.

In the embodiments described herein, the model is a wax model. In some examples, the wax can be a low melting point wax. In the same or different examples, the wax can be a casting wax. In some examples, the wax can include fillers such as fiberglass, talc, or flaky silicon. Using a wax with filler(s) can reduce shrinkage when the wax is cooled from a liquid to a solid and thus, create better models. In other embodiments, other suitable materials can be used to create the models from the mold.

Figure 6:
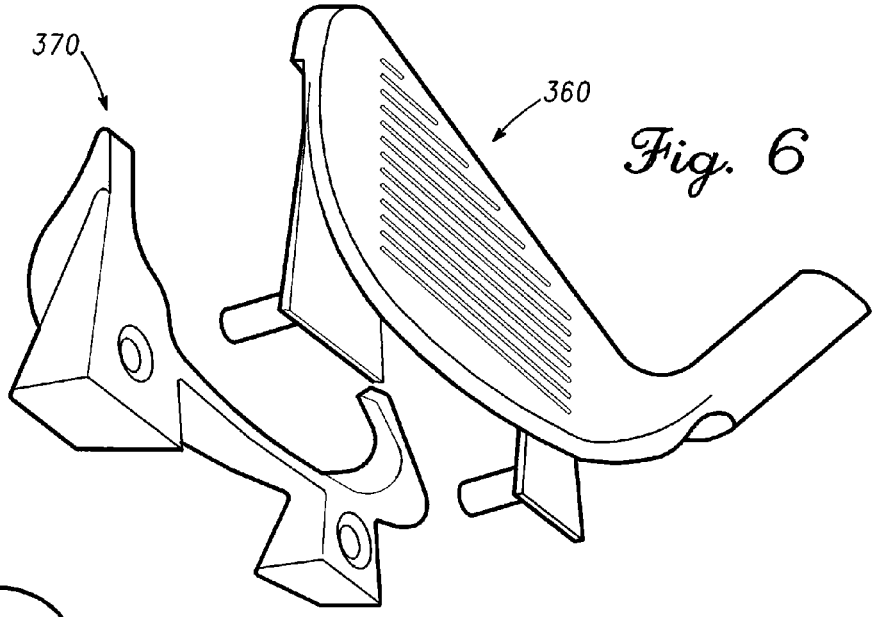
FIGS. 6-7 illustrate additional views of first model and second model portions of FIG. 3, according to the first embodiment.
Figure 7:
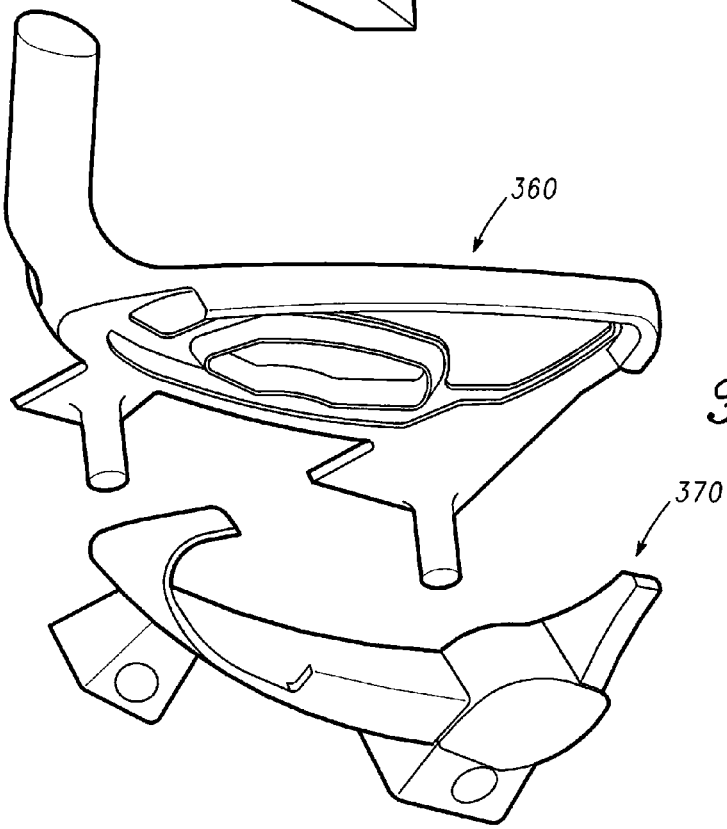

FIG. 3 illustrates an example of first model portion 360 and a second model portion 370 of a model 300 that was formed in activity 111 (FIG. 1). FIGS. 6-7 illustrate additional views of first model portion 360 and second model portion 370. In some examples, mold 200 of FIG. 2 can be used to create wax model 300 as shown in FIGS. 3 and 6-7. Specifically, first mold portion 228 (FIG. 2) can be used to create first model portion 360 and second mold portion 229 (FIG. 2) can be used to create second model portion 370.

In the examples shown in FIGS. 3 and 6-7, first model portion 360 can include strike face mold 361, the reverse side mold 363 of the strike face (i.e., the back cavity with a weight port), a common contact surface 365, and an alignment mechanism 362. Second model portion 370 can include sole/toe/heel mold 371 (i.e., the mold of the sole portion and most portions of the toe and heel of the golf club head), a common contact surface 375, and an alignment mechanism 372. In other examples, first model portion 360 and second model portion 370 can include different combinations of the part of the golf club head or another object.

In still other examples, the hosel portion of the model and the face portion of the model are located on the same model portion. In the same or different examples, the top rail portion of the model is located on the same model portion as the face side portion of the model. In some examples, the sprues can be split between the two or more model portions. In many embodiments, as shown in FIG. 3, the locator alignment mechanism (e.g., projections 368) can be located on the same model portion as the face side portion.

In many examples, alignment mechanism 362 and a common contact surface 365 can be located at, adjacent, or abutting the back surface of the face of the golf club. Placing alignment mechanism 362 and a common contact surface 365 at the back side of the face ensures that the joining of the model portion will not create any seams or other imperfections on the face of the golf club. Some conventional methods include creating ridges on the face side of the wax model. These ridges can create seams or other imperfections that need to be later corrected. In the method described herein, if cosmetic grinding was necessary, the cosmetic grinding would occur on the back of the face portion or the bottom of the golf club head, which is preferable to grinding on the face of the golf club head. Grinding on the face of the club is more costly and time-consuming because the face of the golf club head has more precise dimensions and markings compared to other surfaces.

In various examples, alignment mechanism 362 can be shaped and sized complementary to alignment mechanism 372. For example, as shown in FIGS. 3 and 4, alignment mechanism 362 can include one or more projections 368. Each projection 368 can have one or more pins or protrusions 366 with a radius of curvature 367 at the base of protrusions 366.

Alignment mechanism 372 can include one or more projections 378. As shown in FIGS. 3 and 5, each projection 378 can include one or more holes 376 with a radius of curvature 577 at the edge of a hole 376. Protrusions 366 can be complementary in size and shape with holes 376 such that each protrusion 366 can be placed inside of a different one of hole 376 when first model portion 360 is joined with second model portion 370 to self-align first model portion 360 and second model portion 370. In some embodiments, radius of curvature 577 at the edge of hole 376 and radius of curvature 367 at the base of protrusions 366 can be used to self-align first model portion 360 and second model portion 370. In some examples, a length of protrusions 366 can be greater than a length of holes 376.

In various embodiments, the coupling of the alignment aids can lock the first model portion to the second model portion. In various embodiments, the alignment aids plus the filler or sealant can lock the first model portion to the second model portion.

In other examples, other alignment mechanisms can be used. For examples, dimples and corresponding indentions can be located on the portions of the model and cast to allow proper alignment of the portions.

Referring again to FIG. 1, subsequently, the method 100 of FIG. 1 includes an activity 112 of assembling the model of the item or object. In some examples, activity 112 can include assembling the model of the golf club head.

In some examples, assembling the model can first include placing or applying at least one of a filler substance or sealant on or at the first common contact surface and/or the second common contact (and possibly other portions of the model) to make sure there are no gaps between the surfaces. Additionally, filler or sealant can be placed on or in the alignment mechanisms of the model portions. In one example, filler is used on the common contact surfaces, and a low viscosity sealant is used on the alignment portions. In one example, the filler substance or sealant used can be an adhesive wax stick, manufactured by Jiffy Printers Products of Cathedral City, Calif. The apparatus and methods described herein are not limited in this regard.

In some examples, the filler or the sealant can be placed around or on the alignment aids. In various embodiments, the filler or the sealant can move to other portions of the joint between the first model portion and the second model portion. For example, the filler or the sealant can move by capillary action between at least a portion of the joint between the first model portion and the second model portion.

Next, activity 112 can include physically coupling the first model portion with the second model portion by coupling the first common contact surface with the second common contact surface and aligning the first alignment mechanism with the second alignment mechanism. In various embodiments, the first contact surface is placed adjacent to the second common contact surface and the first alignment mechanism is coupled to the second alignment mechanism. After coupling the first model portion and second model portion, any excess filler or sealant can be removed from the model (or can be removed after the portions are joined as described below).

Subsequently, the first model portion and second model portion are joined. In some embodiments, the first model portion and the second model portion are heated at the seams where the model portions meet, to fuse the wax together.

After aligning the first alignment mechanism with the second alignment mechanism and joining the model portions, activity 112 can include removing a portion of the first alignment mechanism.

Figure 8:
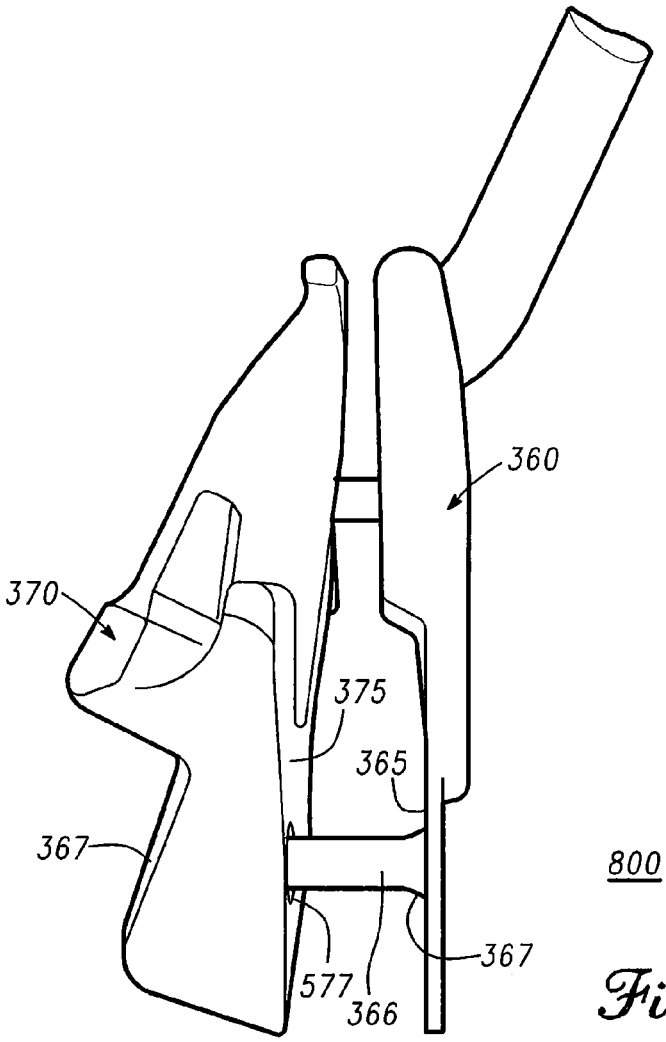
FIG. 8 illustrates a partially assembled model of the golf club head, according to the first embodiment.
Figure 9:
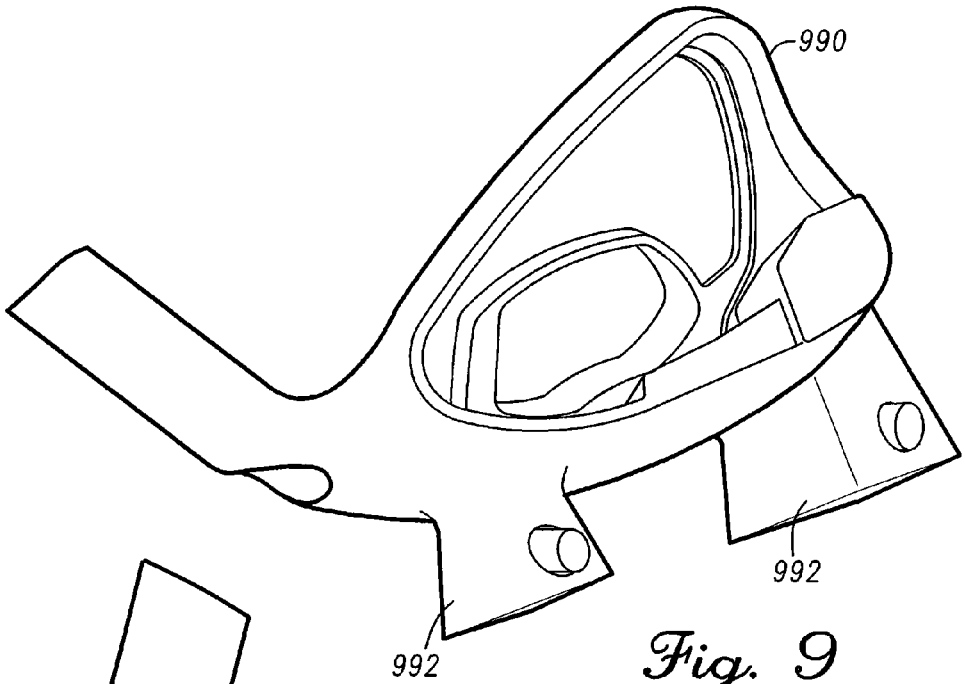
FIGS. 9-11 illustrate a fully assembled model of the golf club head, according to the first embodiment.
Figure 10:
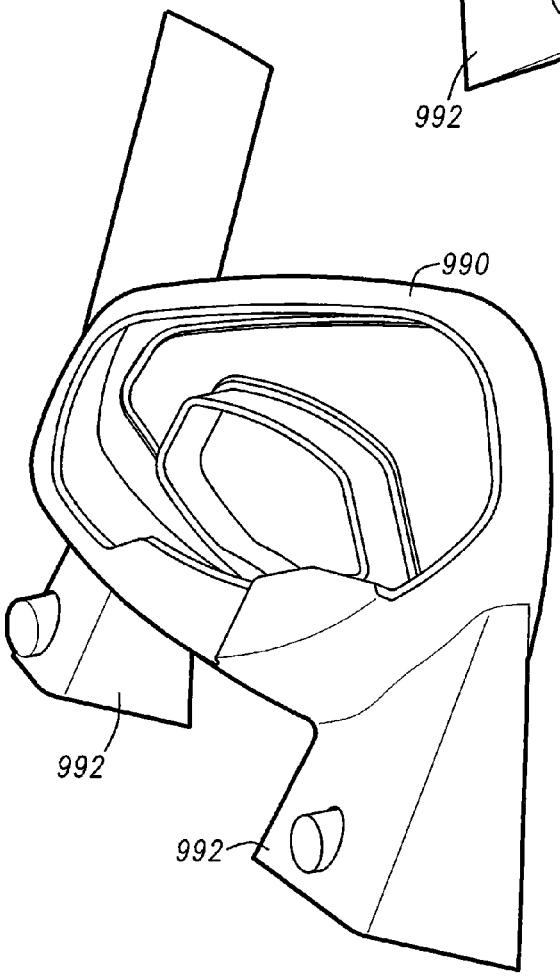
Figure 11:
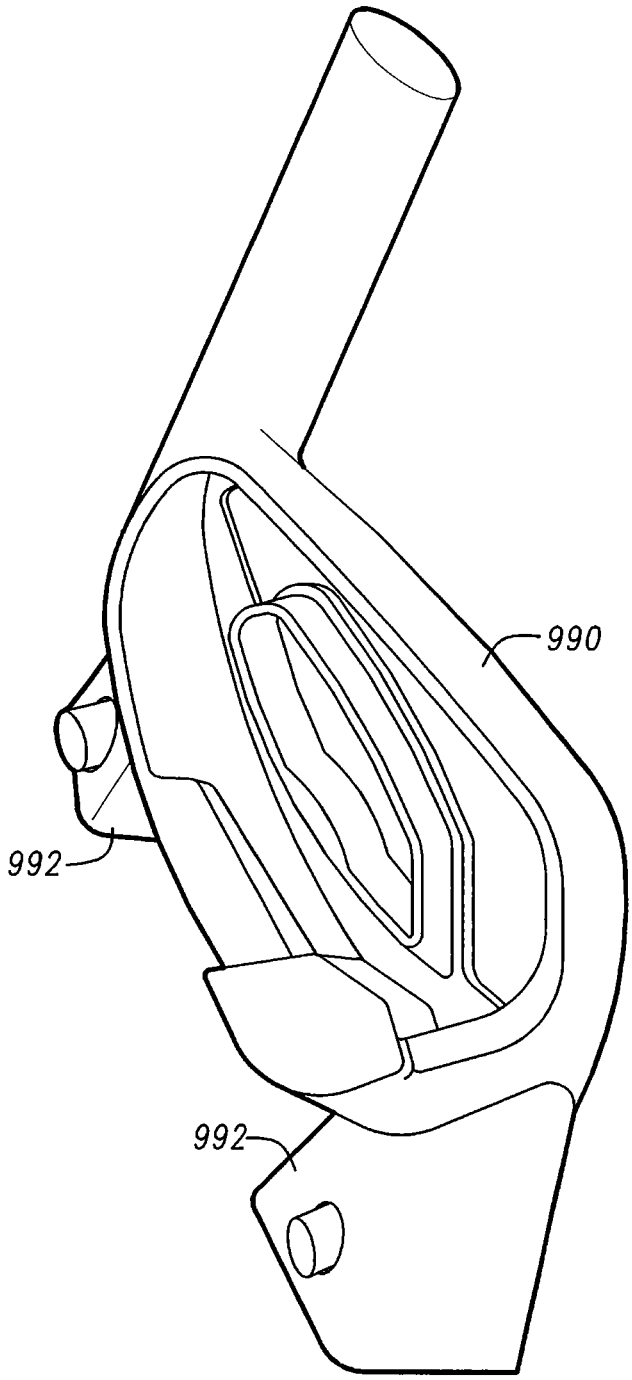

FIG. 8 illustrates a partially assembled model 800 of the golf club head, according to an embodiment. FIGS. 9-11 illustrate a fully assembled model 990 of the golf club head, according to an embodiment.

Referring to the example in FIGS. 8-11, in activity 112, model 990 of the golf club head can be assembled by coupling first model portion 360 (FIG. 3) with second model portion 370 (FIG. 3). In many embodiments, alignment mechanisms 362 (FIG. 3) and 372 (FIG. 3) can be used to properly align first model portion 360 (FIG. 3) with second model portion 370 (FIG. 3). When first model portion 360 (FIG. 3) and second model portion 370 (FIG. 3) are adjacent to one another, they form a seam. The wax can be heated and fused at the seam to form the single model shown in FIGS. 9-11.

In some examples, referring back to FIG. 3, protrusions 366 can be inserted in holes 376 to align the first model portion 360 with the second model portion 370. In various examples, protrusions 366 can tightly fit into holes 376. In other examples, radius of curvature 367 can be aligned with radius of curvature 577 to align first model portion 360 with second model portion 370. In this example, protrusions 366 do not have to fit tightly into holes 376. In some examples, a length of protrusions 366 can be longer than a length of holes 376. In these examples, after first model portion 360 and second model portion 370 are joined, the excessive length of protrusion 366 can be removed.

In some embodiments, a hot knife can be used to cut off any portions of protrusions 366 extending out of holes 376. When the hot knife is used to remove the portions of protrusions 366, the heat can cause wax from first model portion 360 and/or second model portion 370 to melt and flow into holes 376 to hold first model portion 360 and second model portion 370 together.

In other examples, returning to FIG. 9, after the wax hardens, joined alignment mechanism 992 can be removed, leaving only the wax golf club head. In other examples, joined alignment mechanisms 992 are not removed. In addition, in some embodiments, the wax model can be chased to remove any imperfections or marks on the surface of the model.

Figure 12:
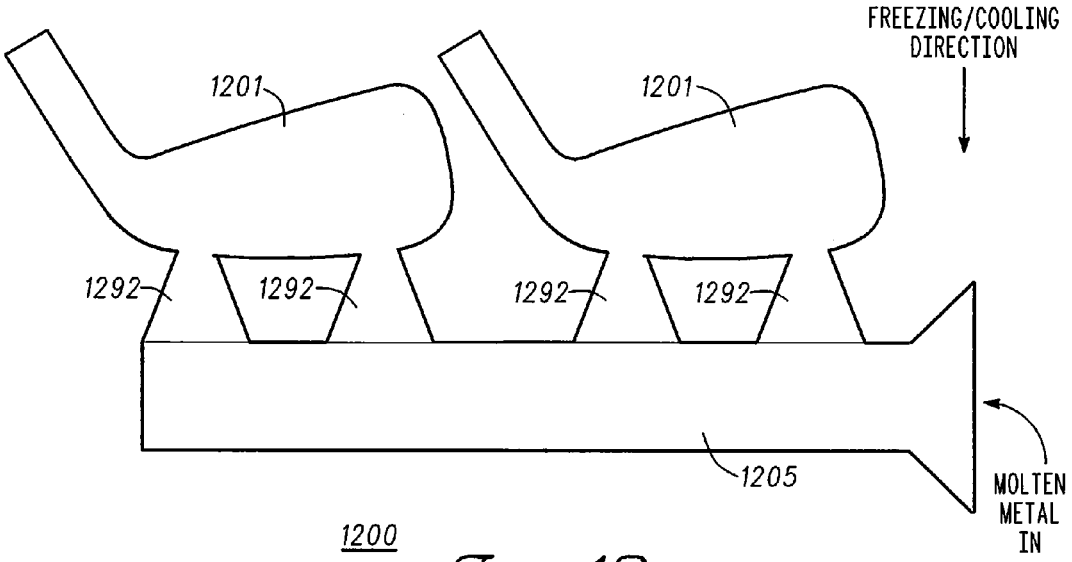
FIG. 12 illustrates an example of two models with a sprue coupled to the models, according to the first embodiment.

Next, the method 100 of FIG. 1 includes an activity 113 of using the wax model to create a cast. In some examples, activity 113 can first include spruing the wax model. FIG. 12 illustrates an example 1200 of two models 1201 with a sprue 1205 coupled to the models. Sprue 1205 can provide a path for the molten melt to enter the cast via regions 1292 in activity 115 (FIG. 1).

In some examples, wax sprue 1205 can be attached to joined alignment mechanisms 992 (FIG. 9). While sprue 1205 could be coupled to model 990 (FIG. 9) at many different locations, in some embodiments, it is advantageous to couple sprue 1205 to joined alignment mechanism 992 (FIG. 9). For example, the conical shape of joined alignment mechanism 992 (FIG. 9) provides a good path to introduce the molten metal into the cast. Furthermore, when injecting the molten metal into the cast, it is good manufacturing procedure that the last part to fill up with molten metal and the last part to cool is the thickest portion of the object or item. In this example, joined alignment mechanism 992 can be coupled to the thickest portion of the golf club head and thus, the preferred location to inject the molten liquid metal.

The method 100 in FIG. 1 continues with an activity 114 of removing the model from the cast. In some examples, the cast is heated to harden the cast and melt out the wax. After the wax is removed, the cast consists of a hardened hollow shell.

Subsequently, the method 100 of FIG. 1 includes an activity 115 of using the cast of the object to create the object. In some examples, activity 115 can include injecting a molten liquid metal into the cast. In some examples, the liquid metal is injected from sprue 1205 (FIG. 12) and the liquid metal flows into joined alignment mechanism 1292 (FIG. 12) and then into golf club head cast 1201 (FIG. 12). Afterwards, activity 115 involves cooling the liquid metal in the cast.

Next, the method 100 of FIG. 1 includes an activity 116 of removing the object from the cast. In some examples, the cast is removed by destroying the cast. For example, the cast can be hammered or sandblasted away from the golf club head. In other examples, other processes can be used to remove the golf club head from the cast.

The method 100 in FIG. 1 continues with an activity 117 of finishing the object. After the cast has been removed, the sprue and the alignment aids can be removed from the golf club head. The golf club head can be polished and undergo additional manufacturing activities to produce the final finished golf club head.

One of the advantages of the method 100 is that the alignment aids are located on the sprue and removed in the finishing process. In conventional methods, wax pieces of the model for golf clubs can be aligned by fitting two pieces of the model together. When these portions are joined, seams and other imperfection can be created on the wax model. The seams or other imperfections will be transferred to cast and then, the final object. Thus, conventional methods require one or more extra steps to remove these seams or other imperfections in the objects. For example, some conventional methods use an extra machining or buffing of at least part of the object to clean up artifacts from the manufacturing process.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that activities 110-117 may be comprised of many different activities and procedures, and be performed by many different modules, in many different orders; that any element of FIG. 1 may be modified; and that the foregoing discussion of certain of these embodiments does not necessarily represent a complete description of all possible embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A method of manufacturing a golf club head, the method comprising:

creating a mold of the golf club head;

forming two or more portions of a model of the golf club head using the mold, each of the two or more portions of the model include a part of a body of the golf club head and at least one first alignment mechanism;

assembling the model of the golf club head using the at least one first alignment mechanism of each of the two or more portions of the model to align together the two or more portions of the model, the model comprises the body of the golf club head and a joined alignment mechanism, the joined alignment mechanism comprises the at least one first alignment mechanism of each of the two or more portions of the model;

using the model of the golf club head to create a cast for the golf club head;

removing the model of the golf club head from the cast;

using the cast of the golf club head to create the golf club head with the joined alignment mechanism; and removing the joined alignment mechanism from the golf club head.

2. The method of claim 1, wherein:

forming the two or more portions of the model of the golf club head comprises:

forming a first portion of the two or more portions of the model of the golf club head using the mold where the first portion comprises a strike face mold, a first common contact surface mold, and one or more projections; and forming a second portion of the two or more portions of the model of the golf club head using the mold where the second portion comprises a back side mold, a second common contact surface mold, and one or more apertures;

the one or more apertures of the second portion are configured to receive the one or more projections of the first portion such that the one or more projections extend through the one or apertures;

the at least one first alignment mechanism of the first portion of the two or more portions comprises the one or more projections;

the at least one first alignment mechanism of the second portion of the two or more portions comprises the one or more apertures;

the part of the body of the golf club head of the first portion of the two or more portions comprises at least the strike face mold;

the part of the body of the golf club head of the second portion of the two or more portions comprises at least the back side mold; and assembling the model of the golf club head comprises:

placing the one or more projections of the first portion into the one or more apertures of the second portion such that the one or more projections extend through the one or apertures, and the first common contact surface is adjacent to the second common contact surface; and removing an end of the one or more projections that extends beyond an exterior surface of the one or more apertures.

3. The method of claim 2, wherein:

removing the end of the one or more projections comprises:

using a cutting tool to remove the end of the one or more projections.

4. The method of claim 3, further comprising:

heating the cutting tool before removing the end of the one or more projections such that while removing the end of the one or more projections, the cutting tool causes an unremoved part of the one or more projections to be bonded to a part of the second portion of the two or more portions of the model.

5. The method of claim 1, further comprising:

applying a wax adhesive to at least one of the two or more portions of the model of the golf club head before assembling the model of the golf club head.

6. The method of claim 1, wherein:

forming the two or more portions of the model comprises:

inserting wax into the mold of the golf club head; and removing the two or more portions of the model from the mold, wherein:

the two or more portions of the model of the golf club head are configured such that an unobstructed removal axis from the mold exists for each of the two or more portions of the model.

7. The method of claim 1, wherein:

forming the two or more portions of the model comprises:

forming a first two-sided mold cavity with a second alignment mechanism and a first common contact surface;

forming a second two-sided mold cavity with a third alignment mechanism and a second common contact surface;

the third alignment mechanism is configured to couple to the second alignment mechanism;

the two or more portions of the model comprise the first two-sided mold cavity and the second two-sided mold cavity; and the at least one first alignment mechanism of the two or more portions of the model comprise the second alignment mechanism and the third alignment mechanism.

8. The method of claim 7, wherein:

assembling the model comprises:

coupling the first two-sided mold cavity with the second two-sided mold cavity by coupling the first common contact surface with the second common contact surface and aligning the second alignment mechanism with the third alignment mechanism.

9. The method of claim 8, wherein:

assembling the model further comprises:

placing at least one of a filler substance or a sealant on at least one of the first common contact surface or the second common contact surface before coupling the first common contact surface with the second common contact surface.

10. The method of claim 9, further comprising:

after aligning the first alignment mechanism with the second alignment mechanism, removing a portion of the second alignment mechanism.

11. The method of claim 1, wherein:

the at least one first alignment mechanism of each of the two or more portions of the model is located adjacent to a thickest portion of the model of the golf club head.

12. The method of claim 1, wherein:

creating the mold of the golf club head comprises:

creating a negative image mold of each of the two or more portions of the model of the golf club head.

13. The method of claim 1, wherein:

using the cast of the golf club head to create golf club head comprises:

injecting a liquid metal into the cast of the golf club head;

cooling the liquid metal in the cast of the golf club head; and removing the golf club head from the cast.

14. The method of claim 13, wherein:

injecting the liquid metal into the cast of the golf club head comprises:

injecting the liquid metal into the cast of the golf club head at least partially through the joined alignment mechanism.

15. The method of claim 1, wherein:

the model comprises a wax model.

* * * * *